US006715762B2

(12) United States Patent
Simmons

(10) Patent No.: US 6,715,762 B2
(45) Date of Patent: Apr. 6, 2004

(54) SYSTEM FOR PROVIDING ENTERTAINMENT AND ENHANCING HUMAN RELATIONSHIPS

(76) Inventor: Jo Ann F. Simmons, P.O. Box 387, Eastsound, WA (US) 98245

( * ) Notice: Subject to any disclaimer, the term of this patent is extended or adjusted under 35 U.S.C. 154(b) by 22 days.

(21) Appl. No.: 09/735,416

(22) Filed: Dec. 11, 2000

(65) Prior Publication Data

US 2001/0042962 A1 Nov. 22, 2001

Related U.S. Application Data

(60) Provisional application No. 60/170,154, filed on Dec. 10, 1999.

(51) Int. Cl.[7] ..... A63F 9/00

(52) U.S. Cl. ..... 273/429; 273/148 R; 273/292; 273/236

(58) Field of Search ..... 273/236, 242, 273/272, 292, 148 R, 429, 430, 431

(56) References Cited

U.S. PATENT DOCUMENTS 4,606,546 A * 8/1986 Rita ..... 273/269
4,635,939 A * 1/1987 Makow
4,836,546 A * 6/1989 DiRe et al.
4,940,239 A * 7/1990 Tuttle ..... 273/243
5,066,016 A * 11/1991 O'Neill ..... 273/249
5,244,391 A * 9/1993 Bryant ..... 434/129
5,295,834 A * 3/1994 Saunders ..... 434/128
5,441,277 A * 8/1995 Lenhart et al. ..... 273/249
5,472,207 A * 12/1995 Sullivan et al. ..... 273/249
5,735,522 A * 4/1998 Sausa ..... 273/249
5,882,008 A * 3/1999 Siegesmund
6,019,370 A * 2/2000 Morris ..... 273/249
6,193,606 B1 * 2/2001 Walker et al.
6,224,056 B1 * 5/2001 Jones ..... 273/249
6,279,909 B1 * 8/2001 Alexander, II et al.
6,315,292 B1 * 11/2001 Howlett et al.

* cited by examiner

*Primary Examiner*—William M. Pierce
(74) *Attorney, Agent, or Firm*—Robert B. Hughes; Hughes Law Firm, PLLC

(57) ABSTRACT

A method or system by which two or more people can improve communication, understanding and/or relationships. The persons engage in a game or other activity where there are triggering events, such as completing a hand of a game of cards, or expiration of a time period. When there is a triggering event, one person selects an item of information at random (e.g. by drawing a card from a stack of information cards). The person reads the information and expresses a thought relating to the same. The other participants are then also able to comment. If this discussion becomes objectionable in some way, one of the participants can activate a "defuser" to either divert the line of discussion or terminate the discussion, after which the activity phase (e.g. a card game, a counseling session, etc.) is continued.

14 Claims, 2 Drawing Sheets

SYSTEM FOR PROVIDING ENTERTAINMENT AND ENHANCING HUMAN RELATIONSHIPS

CROSS REFERENCE TO RELATED APPLICATIONS

This application claims the benefit of the priority of U.S. Provisional Application Ser. No. 60/170,154, entitled SYSTEM FOR PROVIDING ENTERTAINMENT AND ENHANCING HUMAN RELATIONSHIPS, which was filed Dec. 10, 1999.

FIELD OF THE INVENTION

The system of the present invention was originated to promote, create, and/or enhance various human relationships by providing a combination of participation in a game or game-like activity or activities with periods of discussion to exchange ideas on a variety of topics. The components of the system are combined in a way which are in some respects random, and yet arranged to occur so that they complement one another to provide the positive aspects that create better human relationships, and also diffuse, defuse, divert or otherwise alleviate the adverse elements that are impediments to these relationships.

BACKGROUND OF THE PRESENT INVENTION

There are many facets of the subject of human relations, dealing with the process of "getting acquainted", "getting to know each other better", and simply "getting along".

As one example, when a group of people are moving into a new environment, such as entering school as freshmen, or starting a new job, in some instances there would be orientation programs where the newcomers are assembled for a presentation that gives an overview. Quite often the program is arranged so that the people will break up into groups for either workshops, tours of the facility, or structured activities. This may be mixed in with more casual social activities such as a get together where these people have name tags and they move freely among groups to engage in introductory conversations with different people.

Also, at conventions, seminars, and professional educational programs, there will generally be a social hour, again for the purpose of these people meeting each other on a more informal basis. In many instances, alcoholic beverages will be served (generally in moderation), and in more recent times this activity has been given the title of an "attitude adjustment" hour.

In contrast to the two situations given above, some activities are established on a more continuing basis to accomplish not only the initial introductions, but also to promote long range good fellowship and also combine this with community activities. Thus, we have the Rotarians, the Lions, the Elks and many others. There are regular meetings with a meal, a period of announcements done humorously, often a program, etc.

Another broad category is the area of sports and games where, in the course of such activities, people become acquainted with each other and may become good friends. The game of golf, for example, lends itself to a fair amount of off and on conversation. Also, card games leave room for conversation, such as a period when a hand is completed and a person is shuffling the cards and dealing a new hand. In fact, quite often the more enjoyable aspect of such games is the fellowship/friendship that develops.

It is interesting to note that in most all of these situations, as indicated in the above text, the activity or event which promotes the "getting acquainted" and "getting to know each other better" is more to provide the opportunity for the acquaintanceship, but not the actual process of accomplishing it. In other words, there is the opportunity for the people to make the introduction, and then the people are more or less left to their own devices to carry the conversation further. They may "hit it off" where the initial introduction results in a lasting friendship or at least a pleasant acquaintanceship that might be generated from time to time.

However, quite often people have difficulty in making these initial introductions into anything more than the only somewhat "superficial" exchange of ideas or information on some very general topics. They have difficulty in meeting people and making friends. To remedy this situation, we have various books and programs to improve a person's social skills. Decades ago there was the very successful "How to Win Friends and Influence People", a book written by Dale Carnegy, and this developed later into a series of courses to accomplish just what the title of the book expresses.

Then when the closer relationships do develop, such as a good friendship, a family relationship, or a marital relationship, there are also books and programs to facilitate the relationships and get the people over difficulties that occur.

In view of the foregoing, it is only natural that this whole area of human communications and behavior would be studied analytically. One has only to consult a dictionary words beginning with the five letters "p, s, y, c, and h" (derived from the word "psyche") to identify the areas of study that have developed.

Thus we find the term "psychology", which is defined as "the science of mental processes and behavior".

Then there are areas of scientific inquiry which deal with more severe mental problems. There is "psychiatry" defined as "medical study, diagnoses, treatment and prevention of mental illness". Out of this grows "psychoanalysis", the technique developed by Sigmund Freud that uses free association, dream interpretation, and analysis of resistance and transference to investigate mental processes". There is also "psychotherapy" (the psychological treatment of mental, emotional, and nervous disorders).

There are professional counselors who deal not necessarily with more severe human illnesses or aberrations, but more with resolving a wide variety of human/social problems, whether these be problems in the work place, school, marriage, family relations, etc. Many of these counselors develop unique skills and techniques to get to the heart of the problem and find solutions.

Again, it is interesting to note that when the counselors, therapists, psychiatrists, psychoanalysts, and other such professions apply their techniques to situations, they do so where there is a "problem". Where there is a situation of sufficient concern so that the assistance of a specialist is needed, there are programs, books, courses directed toward developing high levels of competence in human communications.

To turn our attention to a rather different aspect of human social activity, In large part, these appear to be focused toward an identified goal, such as making a sale, negotiating a favorable settlement, making a speech to promote a cause or point of view, a lawyer developing the skills to convince a judge or jury, etc. In general, the goal toward which these are directed is to succeed or come out a "winner". Thus, the person who becomes a successful salesman, "gets the sale" and the salesman who is less adept comes out the "loser".

Now we come to this somewhat unique category of human relationships which is what we might term the "boy/girl" relationships. The efforts to foster this in some sort of program or controlled basis begin probably around the age 11 to 13, where there are school dances. Then there is the activity of "dating" which in some instances may lead to becoming engaged and eventually a marital relationship.

In some instances, this "win/lose" approach in the area of "boy/girl" relationships becomes paramount. There are books and magazines on how to succeed in these relationships, how to dress, how to talk, and other guidelines to make one more socially acceptable in the particular arena of boy/girl activity. For better or for worse, this can become a competitive atmosphere.

These boy/girl relationships in general differ from many of the other relationships discussed above in this text in that there is often a strong element of emotion which could be characterized as love, dedication, a caring feeling, etc. Thus, in those situations where the emotional attachment becomes diminished, a married couple has to find out if they actually do have a sufficiently strong bond to maintain and nurture a happy marital relationship.

Now, to transfer our attention to another facet of human relationships, there is often a natural reluctance in most every person to be completely open and candid in communicating with others, particularly in the early "getting acquainted" stage. A person may be avoiding certain channels of conversation or even disguising actual facts simply because that person does not want to appear foolish, inadequate, maybe a little bit "odd", or embarrassed. The corollary of this is that the person would more likely want to convey information which would keep things in an area where the person would not feel threatened, or which may be more likely to enable the person to "look good" or at least in areas where the person might have a comfortable feeling. Also, a person may wish to avoid bringing up subjects that might make another person uncomfortable.

In those instances where a conversation develops and one person finds themselves getting into areas where they would rather not probe, or finding themselves having a somewhat different view on issues where they would rather not have the conversation go further, the relationship often fades at the initial introductory stage.

The discussion up until now has dealt with more general aspects. To appreciate the novel aspects of the present invention, which will be discussed later herein, we should now turn our attention to a more specific activity where there is social interaction, this being a typical game of cards. While participation in some card games can be a highly competitive event, more often people will play a game of cards as a pleasant pastime, where the game itself provides interest and excitement and yet there is a certain amount of conversation that might generally be termed "good fellowship".

For example, let's consider a game of gin rummy. Playing a hand of gin rummy is (like most card games) a combination of skill and luck. A reasonably competent gin rummy player will try to remember which cards have been discarded, remember what cards the other player has picked up from the discard pile, and make his or her decisions accordingly. Thus during the playing of the hand, the player will usually have his mind "on the game", and will not be letting extraneous thoughts demand his attention.

There is a definite recreational benefit to this, in that some of the concerns, worries or frustrations that may be bothering a person will be pushed to the back of his mind. At least during the play of that hand, the person will be concentrating solely on the game.

Then when the particular hand is finished by one of the players knocking or managing to "gin", there is a break in the concentration. Probably the player who is on the losing end of that hand will be expressing somewhat jokingly his frustration that he was waiting for a certain card to go out, etc. Unless the people are highly competitive and/or playing for big stakes, whether the person wins or loses, the total time period in which the number of hands are played will generally be a relaxing and enjoyable event.

Yet between hands while the cards are being shuffled and then the next hand dealt, quite often the people will engage in conversation. Assuming the people are simply relaxing after a few hands of gin after a game of golf, or playing the card game at a family get together, random topics will come up. In a way people sometimes find it easier to bring up these topics in the time periods between when the hands are played (i.e. during the shuffling or the dealing of the cards), because the time frame is short (possibly about 20–60 seconds, and the person does not expect to get involved in the subject in depth. Then if it does become a topic of interest that the two players want to discuss further, they can delay the playing of the next hand to exchange a few more thoughts. However, they will end the conversation by getting back to the next hand.

Over a period of time, assuming that people are both good natured and don't get particularly upset if they're having a losing streak, a friendship can develop, either a rather limited friendship where there are more frequent games, or deeper friendships where the people enjoy each other's company in other social engagements.

This same phenomenon can occur for people who get together on a more or less regular basis to play poker. If the stakes are kept low enough to be within a person's "entertainment budget", and if the atmosphere is overall friendly even if the person has a long run of bad hands, there is time for conversation. After a hand is played and the cards are being gathered, shuffled and again dealt for the next hand, various topics will come up, whether it be a sporting event, a local political matter, some random gossip, etc.

In that kind of environment, particularly where the same people meet as friends on a somewhat regular basis, even if it's once every several months, the people will get to recognize each other's moods, and sense whether a person might be depressed, worried, etc. Under those circumstances the person who is somewhat depressed or concerned may feel more comfortable in discussing the problem at least to some extent during the card game, not only because he is with friends, but because it is in an atmosphere where he can in a sense "turn it on or turn it off", depending on the tempo of the game.

However, if that person is getting into the subject more deeply than he would like to at that time, he has an easy "out" simply by suggesting that it's time to get back to playing the next hand. Also, in these sort of gatherings, such as playing a game of gin rummy, a game of poker, a game of pinochle, hearts, etc. there is generally an understanding that the people are there for recreation and fun. It's against that "code" to bring up subjects which are highly controversial, and if they are brought up it might be done in a humorous way, so they pass it off with humor and then "get on with the business of the game".

These types of relationships are not limited to card games, and they can occur in games such as chess, checkers, horseshoes, etc.

SUMMARY OF THE INVENTION

It is the object of the present invention to provide a new system in the human process of "getting to know each other" in a format or "arena" where two or more people can learn about one another on neutral ground. The system of the present invention does not involve a contest. There are no winners, there are no losers. The only requirement is to have fun discovering one another. The fun comes from an arena safe from competition, judgment, and arguments.

It is further the object of the present invention to promote, create, and/or enhance understanding, mutual respect, possibly friendship or even enhance intimacy, this being done in an environment where there is a more natural and light-hearted discussion which can incorporate humor and discovery. The speaker is not intimidated by the possibility of being judged, and the listener has no need to formulate a defense to the opinion of the other.

The result is a more playful exercise in the serious arena of "hearing" and "being heard". The advantages of the present invention are based upon the philosophy that the more we "hear" from one another, the more we learn who we really are and the respect we have for one another grows.

There is one basic guideline to the discussions, and that is that there are no judgments. One person may agree or agree to disagree, and yet the spirit is not to try to sway the other's opinion. That would be judgmental and counterproductive. Thus, the fun comes from an arena safe from competition, judgment and arguments.

The main phases and physical components of the present invention are the following:

a) The activity phase or time segments in which the participants are engaged in an activity may be a game activity where there is a series of actions, events, or timed occurrences at least some of which are "triggering events" to interrupt that activity for the communication phase. In preferred embodiments this can be a game-like activity such as a card game.

b) The communication phase or time segments is initiated by the "triggering event", after which an item of information is provided to at least one of the participants. In one preferred embodiment, this is accomplished by having a plurality of discussion cards, which can be similar in size (or larger) and shape to playing cards. Also, in one preferred form, the information is a quotation, sometimes with the identification of the person making that quotation, and also some information about that person. Then, in this communication phase, the participants express their thoughts in accordance with a prescribed format. In one embodiment the cards also may display a question to generate some avenue of response. Other types of information items are listed elsewhere in this text.

c) The diversion/defusing phase takes place by one or more of the participants, in a somewhat humorous vein, symbolically eliminate some situation or occurrence in the discussion that is somewhat argumentative or in some other way detracting from the more cooperative, pleasant and sometimes humorous atmosphere of the total activity. In an earlier created embodiment, this is accomplished by use of the "saboteur" which is a physical item that symbolizes or presents an argumentative or judgmental viewpoint or attitude, and the saboteur could be humorously inactivated or diverted. This also could be, for example, a "grump-in-the-box" (which will be described later), which is activated to express or symbolize an argumentative or judgmental view, and then this "grump-in-the-box" is inactivated in a suitable manner to symbolize an end to the controversy. Alternatively, in a later created embodiment, the diversion/defusing device is a more amiable figure such as a "judge-in-the-box" who rises from a contained box to give his "decision" to abate the matter at hand. Other devices will be described elsewhere in this text.

DESCRIPTION OF THE PRESENT INVENTION

Figure 1A:
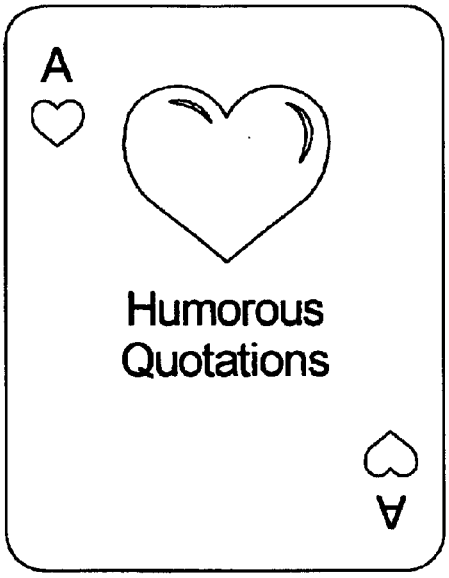
FIGS. 1A and 1B provide, by way of example, isometric views showing the two sides of a standard deck of playing cards for playing a card game which provides the activity that in turn produces the triggering events, and also a set of discussion cards which stimulate the comments and/or discussion.
Figure 1B:
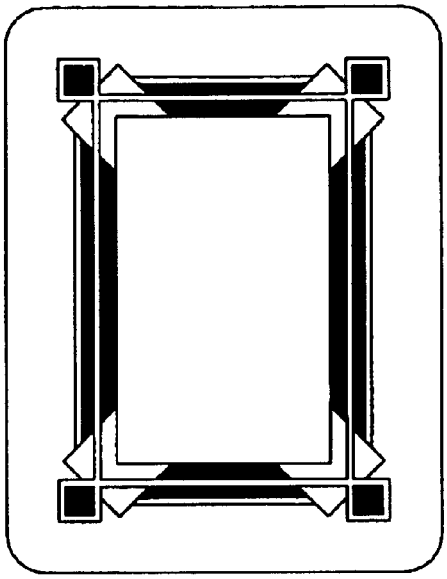
Figure 1C:
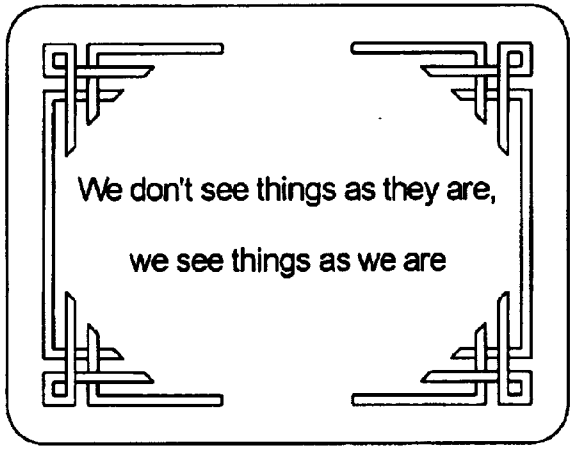
FIGS. 1C and 1D show two sides of a typical discussion card.
Figure 1D:
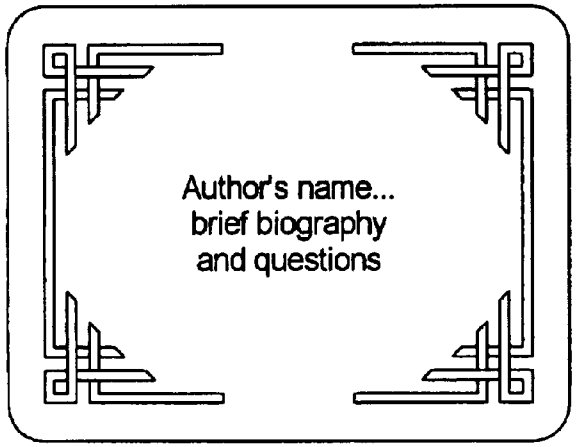

It is believed that a clearer understanding of the system, components and method of the present invention will be obtained by first describing briefly the overall system of the present invention and then describing various features and applications in more detail. In the following text, it will be assumed only two people are the participants.

A) The Sequence of the System

The sequence of the events in a preferred embodiment of the present invention is as follows:

a) The two people agree to play a game, such as a card game. As the game progresses, there will be triggering events, such as one person winning the game, winning a hand in a game of cards, capturing a piece (as in a chess game), or some other identifiable event.

b) Upon the occurrence of the triggering of the event, the "responsible party" for that triggering event (or another person) draws one of the discussion cards. The "responsible person" could be the winner of the hand or game, the person who takes a chess piece or who performs some other act that causes the "triggering event".

c) The responsible person who draws the discussion card reads the quotation and also identifies the author, along with reading the short biographical information about the author and possibly a thought provoking question (if these are present).

d) After reading the card, the responsible person can be the first to express an opinion or maybe a comment, or request the other player or players to express his (or her) thoughts first. In either case, both must eventually express themselves (or will likely do so). It should be remembered that there is no right or wrong answer. The person is simply voicing her or his feelings or possibly making a random comment about something which has been recalled by the person, with the recollection being presumably stimulated by the information on the card, or author, or source of the information.

e) When the people complete their expressions based upon that discussion card, the card game or other game continues.

f) Occasionally, one person will argue that the other's feeling or opinion is wrong or deficient, or make some comment that would make the other person defensive or uncomfortable. When this happens, the diverting/defusing device, which could be the "defuser", comes into play to "defuse" the situation (i.e. snuffing out or eliminating the fuse). Within the broader sense, this "defusing" is meant to include a "diversion" where the potential problem is sidetracked or diverted. This defusing device could be a saboteur, for example, such as the aforementioned grump-in-the-box. As indicated previously, this is simply a box with the imaginary grump inside (see FIG. 2B). This could be activated, for example, by pressing a button. Then the voice emanating from the box begins expressing views which could be argumentative, dissident, judgmental, etc. Then the person who is arguing to change the opinion of the other person or put the other person in a defensive position inactivates the grump-in-the-box. This could be done, for example, by pounding lightly on top of the box which in turn inactivates the voice that is coming from the box. This is a signal to the person who is making judgements or trying to change the opinion of another to discontinue such persuasive comments or judgements, and in accordance with the rules agreed upon, the person making such comments will discontinue this line of commenting.

This shows in a humorous way that when you judge, and try to change the other person's thinking to suit your own, you unleash the greatest threat against any relationship (in a sense, sabotage the relationship). After that, the game continues as described above.

As indicated previously, another desirable option is the "judge-in-the-box", which is a figure of a judge which, when activated, rises from the box to make a proper judicial statement terminating the discussion. Then, the judicial figure is pushed back into the box and the lid closed.

B) The Activity Phase (i.e. The Game)

To describe the activity phase or activity time segment, we shall assume that the basic activity is the card game, such as poker, gin rummy, blackjack, or any other game which the participates find to be enjoyable. This card game will have certain "events" which will "trigger" the start of the communication phase or segment.

For example, in a game of gin rummy the event that triggers the communication phase could be the end of a hand. If more frequent triggering events are desired, then it could be, for example, when one of the players picks a card from the discard pile as opposed to drawing from the stack of cards. In a game of blackjack where each individual "hand" goes by more quickly, the event could be when either the dealer or the player receiving the cards goes "busted".

If the activity is not a card game, but something like chess or checkers, then for the chess game the triggering event could be, for example, when a major piece (i.e. a knight, bishop, rook or Queen, but not a pawn) is captured. Or in checkers it could be when one of the checker pieces is taken off the board. In monopoly, the event could be passing "Go", putting a house or hotel on a piece of property, etc. In the game of scrabble it could be forming a word having some characteristic such as having at least a certain amount of letters (or maybe a quite small amount of letters.

In the following text, the term "game" will commonly be used to denote the activity or activity phase. However, it is to be understood that this term "game" is meant to include other activities (as discussed later in this text) which would not technically be a "game", but could be, for example, a counseling session, an educational activity, or some other activity engaged in by the participants which would provide the triggering events, and also be such that the participants could then return to the activity.

C) The Discussion Phase using the Discussion Cards

When this triggering event occurs, the player who is either the winner of the game or the active player who causes the triggering event (e.g. the player in the gin rummy game who picks up a card from the discard pile) draws a card from the stack of quotation cards. The player reads aloud the quotation on the card and also the name of the person making the quotation, along with the sentence or two giving information about that person, and/or the attached question. The "winner" has a choice of either expressing his or her own idea, opinion, or a random comment first or request the "loser" to express his or her opinion first.

In either case, both must eventually express themselves and most any sort of comment or opinion is acceptable. It is important for the players to keep in mind that each person is simply voicing his or her own feelings, and there are no "right" or "wrong" opinions. Also, the comments or opinion could be about the author alone, the quotation alone, the question alone, or events or issues that somehow are brought up by the quotation or author, or possibly a personal experience relating to the same.

It is important to remember that often the words "human", "woman", or "man" can be interchanged in these quotes. The quotes are chosen to encourage and exchange thoughts and ideas, not to play the battle of the sexes.

In some instances, these quotations can be selected to give people an arena where they can learn about each other in an enjoyable way without judgment. It really requires no skill. These are not the quotations of the people themselves, and each participant must discuss something on the chosen card, or at least related to the information on the card. The overall effect of this is that there is no personal investment or responsibility in the subject which is to be discussed. Accordingly, each participant can approach it in the spirit of lighthearted discovery and conversation.

To state this in other terms, the object of this activity is to promote, create or enhance an understanding of each other (or, in some situations, even an "intimacy") through natural, light-hearted discussion that should flow with understanding and discovery and sometimes humor and laughter. The object of quotation discussion is to learn about one another on neutral ground. The quotes are by others and this enables you to freely get candid, heart-felt opinions with no investment of being right. At the risk of being repetitious, it should be emphasized that a cardinal rule for the productive participation is that:

"There is no right or wrong. There are only perceptions/opinions."

With the need for judgment eliminated, each person speaks freely while the other is set free to truly listen. The speaker is not intimidated by the possibility of being judged and the listener has no need to formulate a defense to the opinion of the other. The result thus can usually be a playful exercise in a serious arena of hearing and being heard, a concept that resides in the soul of intimacy.

The more we "hear" from one another, the more we learn who we really are and the respect we have for one another grows. There is only one basic guideline to the discussions, which is there are no judgments. You may agree or agree to disagree, yet the spirit of the game is that no one is allowed to sway the other's opinion. That would be judgmental and counterproductive. These basic guidelines should be recognized and understood.

Figure 3:
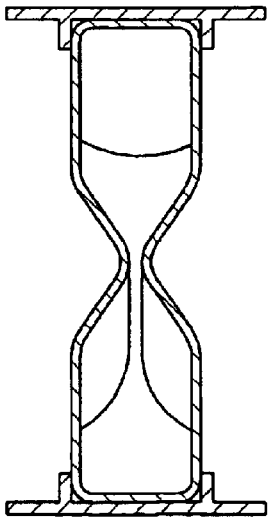
FIG. 3 shows a timer which could be used to set a time limit on the person's comments on the discussion card or person who made the quotation.

In some instances, it may be desirable to limit the time for discussion. If so, a timer can be provided, as shown in FIG. 3. This could be used, for example, to put a time limit on the comments of one person, or possibly a limit on the entire discussion period. In those situations where the discussion is becoming particularly interesting, possibly a person could ask for a reprieve and turn the timer over to start another period running.

D) The Diverting/Defusing Phase

This involves the "defuser". Occasionally one person will argue that the feelings or opinion expressed by the other person is "wrong". This could even be done somewhat unconsciously. When that is perceived, then the person who perceives the situation (generally the person whose feelings are being challenged) can bring forth the "defuser". The "defuser" is symbolic of some person, entity, or "thing" which provides a communication and/or conveys an impression or "idea" that leads to returning to the more tranquil or pleasant atmosphere of the overall activity.

Figure 2A:
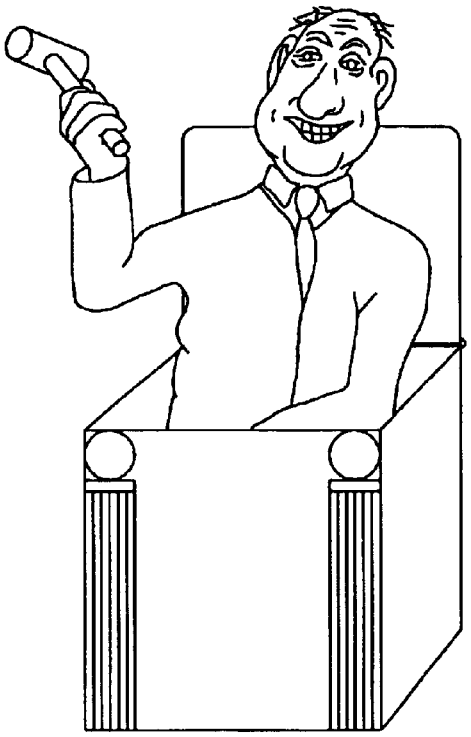
FIGS. 2A–2D are four isometric views of the diversion/defusing devices which accomplish return to the activity phase in a way to maintain the pleasant and sometimes humorous atmosphere which should pervade the overall activities.

In FIG. 2A the defuser is in the form of the judicial figure who, as described above, rises from the box in which he resides to make a judicial pronouncement which either "defuses" the situation, terminates the discussion, or uses a diversion technique to return to the activity phase. The device is activated by a lever which causes the lid to open and the judge to pop up. Various judicial pronouncements that can be made by the judge are shown in FIG. 2A.

Figure 2C:
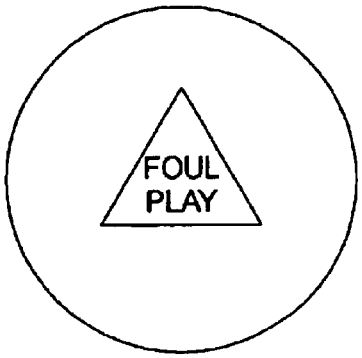
Figure 2D:
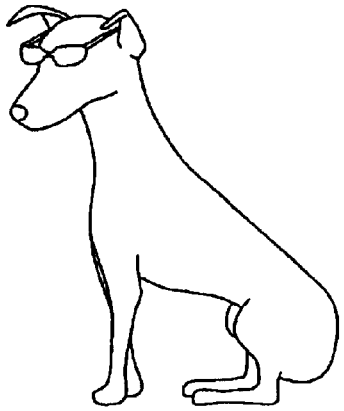
Figure 2B:
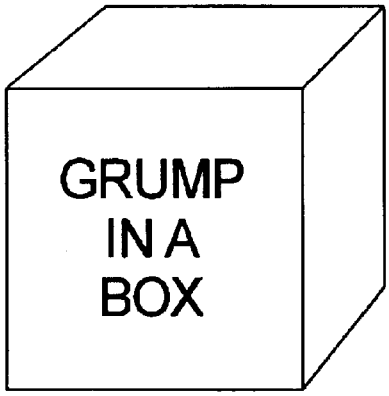

In FIG. 2B, the other "defuser" is in the form of a more disagreeable or argumentative figure which is "inactivated" and possibly inactivated somewhat unceremoniously.

As described previously in this text, this type of defuser can be in the form of the "grump-in-the-box", which is simply a box that contains an audio mechanism which, when activated, makes expressions which are argumentative, judgmental, etc. The expression coming out of the box could even be somewhat incomprehensible and vituperously expressed gobble de gook, or such challenging words as "foul play, not fair", etc. Also, as indicated previously, the grump-in-the-box could be inactivated by either the person who is possibly being argumentative or unfair by simply lightly pounding the top of the box to put an end to the verbiage coming from the box, with the understanding that the person being argumentative agrees to stop. Or the person activating the grump-in-the-box could himself lightly pound the top of the box, with the understanding that the argumentative line of discussion will stop. Then, with the potential tension being defused and/or diverted, the game can go on as before.

This is to show in a humorous way that when you judge, or try to change another's thinking to suit your own, you unleash the greatest threat to any relationship. This threatening judgment/change process must be diffused, defused, diverted, or eliminated, and must be recognized and dealt with in a humorous way together with understanding. This exercise keeps the participants on track, so opinions can be expressed openly and honestly without fear of being judged.

With regard to the other options of the saboteur, in FIG. 2C there is shown a third option which is a round ball having a triangle floating inside the ball. The triangle has a different message written on each surface of the triangle remarking on judgments having been made. A person will shake the ball and a different message comes up.

A fourth option is shown in FIG. 2D, where the "defuser" comes in a more friendly form of a soft sculpture of a dog. The dog is petted gently, and this small pressure makes the dog give a message which is a comment on the argumentative or judgmental situation which has arisen. This could be a saying such as "you make fleas look like fun", or "you can teach an old dog new tricks, but not this way" or "it's not cool to bark judgments".

It is to be understood that more than one defuser/diversion device could be used. Let us assume that all four of the diverter/diffusion devices described above are included in one embodiment of the system. The grump-in-the-box may be activated by a person in a situation where the person feels that the direction of the discussion is more toward an antagonist or argumentative mood. In this situation, the activation of the grump-in-the-box in a way symbolizes this, and would in a way be appropriate for the particular situation.

On the other hand, the situation may be such that it would seem to require a decision from another to terminate this line of discussion, and then the judge-in-the-box would be activated as the appropriate defuser. On the other hand, the person who is to activate the diffusion/diverting device may simply want to make a comment which would indicate that this line of discussion is either inappropriate, irrelevant, and is at least objected to in some way, and the round ball with the various messages appearing would be suitable.

Finally, the activation of the canine defuser could be suitable for, or related to, the treatment the dog is getting, and make the comments such as, "You make fleas look like fun". Also, other types of defusers could be utilized, depending upon the particular manner in which the person may select for the implementation of the diverting or diffusing. process.

E) More about the Discussion Cards

In the preferred form, the preferred form of the information on the discussion cards is at least in part quotations, along the identity of the people being quoted, also sometimes with related biographical or other comments.

The theme of a set of quotations, the selection of the quotations and even the order in which the cards are placed can influence the general direction of the comments and/or discussion that might take place. For example, these could be more thought provoking, or humorous, or both thought provoking and humorous, or even dealing with items which are difficult to take seriously such as fads in diets, popular music, etc.

Also, the themes and selections of the quotations and formatting of the same can be directed toward different general classes of people and also the issues that relate to that class. Also the cards could be structured in such a way to direct or lead the conversation. Further, in addition to using quotations, there are other sorts of information which could be placed on the cards to stimulate a discussion, such as the following:

i. Statistics (e.g. on magazine subscriptions, watching television, travel, human behavior, living habits, etc.)
ii. Fascinating Facts (e.g. customs and habits in other cultures, and other times)
iii. Idioms and Their Origins (unusual way in which words are linked to express thought)
iv. Superstitions and Their Origins
v. Opinions (Gallup polls, etc.)
vi. Oxymorons
vii. Ridiculous (yet real) ads or headlines (e.g. those such as Jay Leno's headlines)
viii. Historic Trivia
ix. Word Origins Further, the quotations themselves need not be erudite or clever quotations, they could be such things as man on the street quotes from real people walking down main-street USA. They could also comprise great movie lines, proverbs from the Bible, multi-cultural proverbs, etc.

Also, in addition to the quotation and identification of the author of the quotation along with a very brief biography, there could be a thought provoking question added. For example, the statement "Go west, young man, go west", attributed to a newspaper editor Horace Greeley, could be followed by the question of "What would life now be like in the United States if the Louisiana purchase had not been made, and if Horace Greeley had not exhorted people to a western migration?"

F) Dynamics of the System of the Present Invention

Possibly a productive way of exploring this subject is to look at the main components of the present invention and how these operate in accordance with the way conversations or exchange of ideas would occur in this system:

i) The Function of the Game Activity.

First, the game activity provides randomly occurring triggering events. Assuming that the game is a card game, a person does not quite know when the hand is going to end or other triggering event is to occur. Accordingly, the person can simply concentrate on the game and when the triggering event occurs, he or she can temporarily forget about the game.

Second, the game provides a change of pace. The game temporarily stops, and after the discussion card is read and the comments of the players are made, the participants would get back to the business of playing the next hand. The benefit of this is that during the period of expressing opinions or making comments, a person may be exploring his or her own feelings, and the person for the moment possibly becomes somewhat introspective or have an emotional response that could be somewhat unsettling. If the quotations are presented over a long period, with each one requiring a comment, and there is no break in this, it could be somewhat fatiguing and the repetition can become boring. However, with a game providing interruptions and getting a person's mind on something totally different (i.e. the game), that repetition and/or fatigue factor is in large part avoided.

Third, the game itself provides something of a safe haven. It may be that the subject matter that is suggested in some quotation may involve something about which one of the players is rather sensitive. With the rules of the game being to comment in any way you feel appropriate, it would be perfectly appropriate for the person to avoid making any profound comment on that particular subject and simply pass it off with humor, or possibly recount some incident. Further, if the person simply feels like avoiding the subject entirely, the person may make some totally extraneous statement, such as "For some strange reason, this reminds me of my trip to Chicago in 1987", and then recount something totally irrelevant. (However, this approach probably should be used less frequently).

ii) The Discussion Cards.

To comment, for instance, on those cards on which there are quotations (possibly with biographical information), desirably each set of quotations would be chosen because it is one that would stimulate various reactions of some sort, possibly a humorous reaction, a comment on some more profound social issue, a recounting of a personal incident that was particularly meaningful to that person, expressing a point of view that is somewhat out of the ordinary or is out of step with the conventional thought, etc.

In many instances where the quotation is read, it is a subject which a person probably would not normally bring up in an early part of a "getting acquainted" conversation. However, in the format of the present game/discussion activity, when a potentially personal or sensitive subject is brought up, the comments, whether off-hand or expressing a firm conviction of the person, can be given without any great apprehension of adverse consequences (provided of course the game is conducted in the proper spirit). Thus, there is potential of obtaining meaningful personal insights about the person in a new relationship which could take years to discover otherwise.

Another benefit of this game is that the topics that are stimulated by the discussion cards could be selected for the occasion. For example, in a boy/girl relationship that is in the initial or early stages of "getting acquainted", there may be one set of discussion cards. Or for a couple who are trying to recapture a relationship that has gone somewhat stale, another set of quotations may be appropriate. For a group of people who are parents and neighbors, a set of cards dealing with family, traveling, education, politics, etc. may well be acceptable. Thus, at least to some extent, the selection of the subject matter of the quotation cards can influence the situation.

Also, as an added feature, one or more "wild cards" or "joker cards" could be added. The card would be mixed into the deck of cards. The wild cards will be added to allow the holder to ask a particular question they would like answered, pass on answering or giving an opinion, recall a favorite quotation or make up one, or take more speaking time than would normally be allowed (i.e. turn over the timer if an hourglass timer is being used), or some of these options could be specified on the wild card. Also, the wild card could be held until needed upon which time it is used and then replaced into the deck.

iii) The Diverting/Defusing Device.

This is the "safety valve." In some situations, as indicated above, the discussion may develop in a way that one or more of the participants is becoming somewhat judgmental or argumentative. This diverting/diffusing phase of the system enables a person who feels threatened or perhaps some discomfort or embarrassment (or even attacked) to get out of the situation without explanation.

Thus, in the use of the diverting/defusing device, this is a signal that the person, for whatever reason, would prefer to get back to the game of cards or at least get the discussion on a different track.

iv) The Element of Personal Discovery.

The subjects can be varied and far-reaching. The atmosphere that is created is intended to lead people into a wide variety of subjects, which could be as diverse as romance, travel, landscaping, living at the South Pole, etc. There can be quotations such as Thoreau's statement that "Most men live a life of quiet desperation", leading to thoughts on basic life styles and the meaning of the same. With the random pacing of the discussion periods and the "safety valves", the people can embark on this path of discovery in an atmosphere adventurous and have a safety from adverse social consequences.

G) Use of the System in a Classroom

This system, slightly modified, can be integrated into the classroom where there is a teacher or a supervisor. This version would be implemented into most levels of education starting at elementary school level and continuing to the highest level of education. The subject matter of the discussion cards selected would reflect the maturity of the children involved. The following features should be noted.

i) The basic rules remain the same;

ii) The supervisor or a student reads the quotation and the short biography of the person quoted aloud. The discussion that follows should be a free flowing exchange amongst the students;

iii) The supervisor refrains from judgment or comments directed at any student interpretation.

iv) The supervisor is a referee, intervening when one student tries to change another students opinion. The supervisor explains the "defuser" and provides the devices used to bring attention to the role of the "defuser". The form given to the "defuser" is subject to the variations needed to be appropriate for different levels of student maturity and the subject matter.

v) The referee (i.e. supervisor) also provides for "time out", when necessary, to bring attention to the "art of listening and hearing".

vi) The supervisor should not critique the grammar of the expression as in an English class. Correction or bringing attention to the ability of the speakers to express themselves will result in inhibition and that is to be avoided as it will destroy the intent of the course. The aim here is for the children or students to be comfortable to say a wide variety of things, in any form of verbal expression they choose.

vii) The students are encouraged to bring their choice of quotes to class as well as compose a short biography of the author. They are encouraged to create their own quote accompanied by a short autobiography. These are never forced or required, only encouraged.

viii) The benefits of this course are outline below; The students are exposed to philosophy and philosophical debating. They are learning to "hear". They experience being heard. The process opens an arena for them to say a variety of things without fear of repercussions regarding their beliefs or opinions. This safe arena is necessary to ultimately reach the goal of this class.

The manner in which this is incorporated into the classroom can vary. For example, this could be used in connection with, for example, a history class, an English class, a Civics class, a Psychology class, etc. The "activity" could then be the routine which the teacher normally follows, and this could be interspersed with the use of the discussion cards. For example, if the particular subject at that time is an historical event that had happened a century or two earlier, the discussion card could present a situation where an alternative occurrence might take place, or the same or a similar occurrence would occur in some other environment, some other country, or some other time frame.

Another alternative is that the system could be incorporated in a classroom environment where it is intermixed with the curriculum in such a way to be used as a counseling tool. This brings us to the next subject which is discussed immediately below.

H) Use of the System as a Counseling Technique

When the system is used in the classroom as a counseling tool, this gives the teacher or counselor an opportunity to recognize a troubled youth based on their response to some of the quotes, or their personal choice of quotes and authors. Mental note should be taken of students who exhibit potential problem areas (i.e. violence, lack of emotion or sensitivity, inability to express themselves, etc.).

The teacher then has the opportunity to see that the student discreetly receives the necessary attention needed. All this has the very real potential of diverting a tragedy.

Care must be taken that the help received is not publicly associated with the class. If the association is made, the students may become inhibited. Those inhibitions would be fatal to the intent of the course, which is to find potentially troubled children before a tragedy develops.

In other environments, there could be a group counseling or a group therapy discussion, and this would be interspersed with the discussion cards and the defusing devices.

The counseling could deal with specific classes and specific types of problems, and this could be used for children who are expected to deal with such problems as:

i. facing divorce;

ii. facing hospitalization, serious illness, death of a relative;

iii. grandparents;

iv. arrival of a new sibling.

In this instance, the defuser would perhaps be a wind-up bug to symbolize that it bugs them when you judge them or don't hear them.

There can also be such techniques used for adults in situations such as the following:

i. Romantic couples renewing or discovering a relationship;

ii. Senior citizens preparing for twilight years, and facing/coping with future changing needs;

Also, the counseling could occur not just in situations where people are facing problems, but also in counseling sessions where people are simply looking at how to enhance their lives, such as what are sometimes called in religious gatherings a "retreat". Further, the therapy sessions could simply be where a person is seeking "time out" to evaluate his or her situation in life, and they want to create some insights or ideas or goals as to how they might want to change their lives. In this instance, the activity, which would be interspersed with the discussion cards, could be a program in which certain concepts are presented, and the timing of the discussion periods using the discussion cards could be at timed intervals, the length of which could depend upon various factors.

I) Alternative Forms of the System

As indicated earlier in this text, the term "information cards" within the broader scope of the present invention is intended to include other forms of communication. For example, instead of the information being in writing, the information could be presented audibly. Further, it could be presented visually through electronic media.

As a further alternative, participation in this activity could occur in an environment other than a face-to-face environment where the people are in the same room. The presentation of the information could be over the internet, and the discussion could be conducted over the internet. Further, the activity portion of the system could also be an activity engaged in over the internet, and could even be a game which could be played by two or more participants transmitting their moves over the internet. In fact, this could lead to innovations where certain individuals who are seeking the help of the "defuser", could use their own imaginative forms of accomplishing the diversion, defusing or elimination of the unwanted occurrence or trend of the discussion.

It is obvious that various modifications, adaptations, and improvements can be made within the broad scope of the system of the present invention.

In the following text there are given examples of quotations, comments on the author or text, and in some instances questions to stimulate thought and/or discussion.

| Quote | Quote Comment | First Name | Last Name | Life-span | Biography | Biography Comment |
|---|---|---|---|---|---|---|
| The injuries we do and those we suffer are seldom weighed on the same scales. | Proof of this quote is in the biography. | | Aesop | 6th century BC | Aesop (of fable fame) was a slave from Phrygia who eventually gained freedom, followed much to his surprise by being thrown over a cliff by a band of angry priests. | They just didn't, appreciate his witty blasphemies. They did prove his theory. |
| Charm; that quality in others of making us more satisfied with ourselves. | Is being charming universally attractive? | Henri Fredrick | Amiel | 1821–1881 | Swiss writer and philosopher as well as professor of aesthetics in 1849 then turned professor of moral philosophy 1853–81. | We thought mid-life career changes were a sign of our times. |
| There's a world of difference between truth and facts, Facts can obscure the truth. | It is easy to feel the truth of this; it is another thing entirely to come up with an example of this. | Maya | Angelou | 1928– | Born Margarite Johnson became a mother at 16, held a string of jobs from cook and waitress to civil rights activist, novelist and celebrated poet who performed in 1993 at President Clinton's inauguration. | The rise of an unwed 16-year-old black mother in 1944 to reading her poetry at a Presidential Inauguration is an ascent against all odds. |
| People who think they know everything are very irritating to those who do. | | | Anon | | None | |
| The work praises the man. | Has pride in one's product been replaced by pride in the amount of money one can receive for that product regardless of quality. | | Anon | | None | |
| Opportunities are never lost. The other fellow takes those you miss. | Do people purposely pass on opportunities so their friends may take them? | | Anon | | None | |
| When a man points his finger at someone else, he should remember that three of his fingers are pointing at himself. | | | Anon | | None | |
| Shortly after the introduction of the | | | Anon | | None | |

-continued

| Quote | Quote Comment | First Name | Last Name | Life-span | Biography | Biography Comment |
|---|---|---|---|---|---|---|
| under wire bra, Valium was invented. Coincidence? | | | | | | |
| Dancing is a perpendicular expression of a horizontal desire. | | | Anon | | None | |
| If you catch a man, throw him back. | | | Anon | | None | |
| They couldn't find the artist, so they hung the picture. | | | Anon | | None | |
| Men their rights and nothing more; women their rights and nothing less. | | Susan B. | Anthony | 1820–1906 | Liberal Quaker and radical reformer active in the anti slavery and temperance movements. Anthony, teamed with Elizabeth Cady Stanton, worked tirelessly to succeed in securing the right of women to vote. | |
| So many women don't know how great they really are. They come to us all vogue on the outside and vague on the inside. | Isn't it easy to make a judgment based on outward appearances? | MaryKay | Ash | | Mary Kay, cosmetics success story. | Remember the pink Cadillac's, how vogue on the outside can you get? |
| If you think you can, you can. And if you think you can't, you're right. | | MaryKay | Ash | | Mary Kay, cosmetics success story. | Remember the pink Cadillac's, how vogue on the outside can you get? |
| Violence is the last refuge of the incompetent. | Define incompetence. | Isaac | Asimov | 1920–1922 | Award winning author of 400 books mostly scientific, some science fiction. | He excels in his ability to make clear descriptions of complex ideas. |
| If I had my life to live over again, I'd make the same mistakes, only sooner. | | Tallulah | Bankhead | 1903–1968 | Being the daughter of a congressman didn't stop Ms. Bankhead from becoming an unconventional often outspoken and very successful actor of stage, screen radio and television. | |
| You grow up the day you have your first laugh at yourself. | Do you actually know people who are unable to laugh at themselves | Ethel | Barrymore | 1879–1959 | American actress from a family littered with actors, including John | |

-continued

| Quote | Quote Comment | First Name | Last Name | Life-span | Biography | Biography Comment |
|---|---|---|---|---|---|---|
| | occasionally? | | | | and Drew, won 1944 academy award for None But the Lonely. | |
| Your own mind is a sacred enclosure into which nothing harmful can enter except by your permission. | What could be next, taking responsibility!!!!!! | Arnold | Bennett | 1867–1931 | English novelist, wrote The Old Wives Tales and became editor of the 1900 journal "Woman". | Has anyone asked why is this man writing a journal called "Woman"? |
| If you can't be a good example than you'll just have to be a horrible warning. | Good example by default? | Catherine | Bird | | NONE | |
| Self-confidence is nothing special. It is the absence of self-consciousness, nothing more, nothing less. | How do you think self-esteem fits into all this? | Laurence | Boldt | | Career consultant and author. His book, Zen Soup, is a wonderful compilation of wisdom drawing from great minds east and west. | |
| I am not a glutton - I am an explorer of food. | If you look at everyday things in life as an exploration does your attitude change? | Emma | Bombeck | 1927–1996 | Popular American humor columnist and author of such books as; If Life is a Bowl of Cherries-What Am I Doing in the Pits, When You Look Like Your Passport Photo It's Time To Go Home and All I Know About Animal Behavior I Learned in Loeman's Dressing Room. | |
| The only person who listens to both sides of an argument is the fellow in the next apartment. | His opinion would be he's angered by having to listen to it. | Ruth | Brown | | NONE | |
| I've never had but one wrinkle, and I'm sitting on it. | | Jeanne | Calment | 122 years | Apparently wrinkle free, save one, French women/ chocoholic who smoked like a chimney finally passed on at the age of 122 years. | |
| Don't think of what's being said but of what's talking, malice?, ignorance?, pride? or love. | Dogs have been known to approach people with tail wagging and as they've reached out to pet them, the dog bites! Is this quote | Joseph | Cambell | 1904–1987 | Native New Yorker and father of theory that all myths and epics have a common origin in the need of the human psyche as it relates to social, | |

-continued

| Quote | Quote Comment | First Name | Last Name | Life-span | Biography | Biography Comment |
|---|---|---|---|---|---|---|
| | saying a similar situation exists with humans? | | | | cosmic and spiritual reality. | |
| Any fool can criticize, condemn and complain - and most do. | What do you think of a person engaging in this type of negative conversation? Does the subject matter make a difference? | Dale | Carniegie | 1888–1955 | Pioneer in public speaking. Highly successful author of one of the best sellers of all time, How To Win Friends And Influence People. | |
| A pat on the back, though only a few vertebrae removed from a kick in the pants, is miles ahead in results. | Positive reinforcement over corporal punishment? | Bennett | Cerf | 1898–1971 | Co-founder of Random house. Editor of humorous anthologies who regularly appeared on television, he was also a syndicated newspaper columnist, publisher, and editor. | |
| All generalizations are false, including this one. | | Alexander | Chase | | None | |
| A women can become a man's friend only in the following stages - first an acquaintance, next a mistress, and only then a friend. | What's the chance this guy had a lot of female friends? | Anton | Chekhov | 1860–1904 | Famous Russian author who supported his family while he attended med school by writing comedy for lowbrow humorous magazines. In these articles he mastered the difficult art of saying a great deal using very few words. He moved from comedy to such fun topics as human isolation and suffering, even here he uniquely undercut the sadness with a comic remark or action therefore causing the audience to experience several deeply mixed emotions. | The Cherry Orchard, a play about a family's loss of their ancestral estate, seems to be a sad topic. Chekhov, however, insisted it was a comedy!! His sense of humor is as interesting as his life story. |
| Every man is important if he loses his life; and every man is funny if he loses his hat and has to run after it. | No one escape being mourned or laughed at so enjoy it all, and if you're really uptight wear a hat. | G. K. Gilbert Kieth | Chesterton | 1874–1936 | British poet and author of works on social and literary criticism, theological studies and detective stories. His sharp wit, controversial views and mastery of paradox made the absent-minded author very | Interesting combination; master of paradox and absent-mindedness, almost a paradox in its own right. |

-continued

| Quote | Quote Comment | First Name | Last Name | Life-span | Biography | Biography Comment |
|---|---|---|---|---|---|---|
| | | | | | popular. | |
| I like living. I have sometimes been wildly, despairingly, acutely miserable, racked with sorrow, but through it all I still know quite certainly that just to be alive is a grand thing. | When is ending a life acceptable? | Agatha | Christie | 1890–1976 | English novelist and playwright of mysteries with suspenseful plots and unexpected conclusions. | Why does one who so loves life write so many murder mysteries? Paradox or hidden desire? |
| A fanatic is someone who can't change his mind and won't change the subject. | Having been said by one of histories greatest wartime leaders is it not interesting that wars are usually the work of fanatics religious and otherwise. | Winston | Churchill | 1874–1965 | British Prime minister 1940–1945 and again in 1951–1955. He achieved a world reputation as an all-seeing strategist and inspirational war leader. He is often described as many men in one because of his many diversified talents. | |
| Your worst humiliation is only someone else's momentary entertainment. | Can you name a situation when this wasn't true? | Karen | Crockett | | NONE | |
| Women are more attracted to men with long strides. | With long fingers, long feet, big hands, long noses . . . alright already, do you notice a common denominator here? | | Curiosity | | None | |
| Look at this view young lady. | Response from a homeless man sitting on a beach in winter when asked why he wasn't in a warm shelter. | | Curiosity | | None | |
| Author of many science fiction novels, H. G. Wells, predicted and named the atomic bomb in 1914. | Many ideas first explored in science fiction become reality or even the impetus for exploration by scientists, can you recall any. They say star trek has actually given scientists many new avenues of exploration. | | Curiosity | | None | |

-continued

| Quote | Quote Comment | First Name | Last Name | Life-span | Biography | Biography Comment |
|---|---|---|---|---|---|---|
| A toilet will injure One in 65 Americans in their lifetime. Most will be men. | How many men suffer injuries inflicted by angry women who used the toilet after the seat was left up? | | Curiosity | | None | |
| The Vampire Research Center in Elmhurst NY has been thriving since 1972. | Is it more acceptable to believe in aliens or ghosts than vampires? Are any of them acceptable? | | Curiosity | | None | |
| Chances that the cash in an American's wallet is organized by denomination:9 in 19 | If your life is in chaos, at least your money is in order! Is this one frantic grasp at something controllable in our lives. | | Curiosity | | None | |
| Recent studies suggest 57% of men placing personal ads said looks are important, while 26% of women said same. 41% of women wanted someone humorous while only 21% of men wanted someone fun; 33% of men wanted someone slim or petite while only 2% of women look for lean. | It appears girls really do just want to have fun, or it's up there on the requirement list. | | Curiosity | | None | |
| Among People's top ten worries at the gym, falling down during aerobics. | The visuals attached to this one make it understandably humiliating to those at the gym for vanities sake. | | Curiosity | | None | |
| The highest possible stage in moral culture is when we recognize that we ought to control our thoughts | Is there an evolutionary process for "moral culture"? Is it possible to control your thoughts? If so, how then can you control your thoughts on how to control your thoughts? | Charles | Darwin | 1809–1882 | British leader in evolutionary biology, discoverer of natural selection. His theories were condensed into the famous treatise that rocked the world, "The Origin of the Species by Means of Natural Selection". His theories have been widely | This leader of evolutionary biology married his cousin, hence slamming his own family's evolution to a grinding halt! |

-continued

| Quote | Quote Comment | First Name | Last Name | Life-span | Biography | Biography Comment |
|---|---|---|---|---|---|---|
| | | | | | accepted. | |
| I get my exercise acting as pallbearer to my friends who exercise. | Think this quip made him friends of the physically fit. | Chauncy | Depew | 1834–1928 | Celebrated witty after-dinner speaker. Secretary of the State of New York 1863, President of N.Y. Central Railroad, U.S. Senator 1899–1911. | |
| A pessimist is a man who thinks all women are bad. An optimist is one who hopes they are. | | Chauncy | Depew | 1834–1928 | Celebrated witty after-dinner speaker, Secretary of the State of New York 1863, President of N.Y. Central Railroad, U.S. Senator 1899–1911. | |
| It is not good enough to have a good mind. The main thing is to use it well. | Have you observed a dog thinking? Do some dogs appear to use their mind as opposed to others? | Rene' | Descartes | 1596–1650 | Not only known as the father of modern philosophy, he discovered and formulated co-ordinate geometry in 1637. | This is a man who used his mind very well. |
| To be conscious that you are ignorant is a great step toward knowledge. | Is being conscious of ignorance and doing nothing to correct it a great step backward? | Benjamin | Disraeli | 1804–1881 | British statesman and novelist who had a profound 30-year influence in British politics despite his maiden speech being drowned in shouts of laughter. | We all get laughed at sometime no matter how influential we may be. |
| Man is not the creature of circumstances. Circumstances are the creatures of men. | Is this another chicken vs. egg conundrum? | Benjamin | Disraeli | 1804–1881 | British statesman and novelist who had a profound 30-year influence in British politics despite his maiden speech being drowned in shouts of laughter. | We all get laughed at sometime no matter how influential we may be. |
| Assumption is the mother of screw-up. | Do you know of any examples where assumptions have not only been wrong but had disastrous results? | Angelo | Donghia | | NONE | |
| We should tackle reality in a slightly joking way . . . otherwise we miss its point. | What is its point, or is there a point? | Lawrence | Durrell | 1912–1990 | British novelist, poet and diplomat turned English teacher in Athens during world war II. He wrote several famous works drawing on his diverse experiences | He seemed to have maintained his sense of humor despite having narrowly escaped the Germans via a fishing boat. |

-continued

| Quote | Quote Comment | First Name | Last Name | Life-span | Biography | Biography Comment |
|---|---|---|---|---|---|---|
| | | | | | abroad. | |
| Only two things are infinite, the universe and human stupidity, and I'm not sure about the former. | | Albert | Einstein | 1879–1955 | Winner of the 1921 Noble Prize for physics was also an outspoken philosopher and humanist who co-wrote "Why War" with Sigmund Freud in 1933. | Strange and interesting bedfellows, Freud and Einstein. Imagine what they would discuss. You could have a field day with this one. |
| Your imagination is your preview of life's coming attractions. | How do you imagine yourself in the future? Take care to answer just in case Albert's right. | Albert | Einstein | 1879–1955 | Mathematical physicist, conceptual reviser of man's understanding of the universe. Among his many achievements, the concept of a space-time continuum, the theory of relativity, and the ability to admit "my wife does my mathematics." | |
| A difference of taste in jokes is a great strain on affections. | Can a person learn to appreciate differences in humor? | George | Elliot | 1819–1880 | Marian Evans Cross, a great English novelist who had a significant effect on women's literature, unfortunate or telling of the times, that an icon like this should choose the pseudonym of George Elliot. | Due to her historical period she had little choice but to use a male pen name, what do you think? |
| I've never any pity for conceded people, because I think they carry their comfort about with them. | At least they're always with someone they love! | George | Elliot | 1819–1880 | Mary Ann (Marian) Evans was considered among the greatest of English novelists. She eloquently depicted life of the lower middle class while her home was a center of intellectual and literary life during the Victorian era. | What a life of opposites, think about it, a women writing under a male pen name, creating extraordinary pictures with her writing of the lower middle class, while her home is literally considered a cultural center. |
| Fear always springs from ignorance. | Do people embrace ignorance by being too freighted to ask questions? | Ralph Waldo | Emerson | 1803–1882 | American poet and essayist. Advocate of spiritual independence, believed in intuition as divine guidance and in individualism to it's fullest. | |
| Whatever limits us we call fate. | Do people use "fate" as an excuse or defense? | Ralph Waldo | Emerson | 1803–1882 | A unique voice of American influence. He was a writer, poet and | |

-continued

| Quote | Quote Comment | First Name | Last Name | Life-span | Biography | Biography Comment |
|---|---|---|---|---|---|---|
| | | | | | philosopher who subscribed to Transcendentalism, a philosophy that stresses humans undeniable ties to nature. | |
| Men are disturbed not by things that happen, but by their opinions of things that happen. | Can you trace something disturbing back to an opinion you had? Would you feel differently by looking at and maybe changing that opinion now? | | Epictetus | b. approx AD 50 | A slave in Rome who upon being freed devoted his life to philosophy. | What would it be like to be a philosophical slave? |
| Go the extra mile. It's never crowded. | | Newsletter | Executive Speechwriter | | NONE | |
| Setting a good example for your children takes all the fun out of middle age. | How wild do you think your parents could have been without you around, what naughty activities would have appealed to them? | William | Feather | | American businessman | |
| Perhaps if one really knew when one was happy one would know the things that were necessary for one's life. | Can you recognize patterns in behavior? In your behavior? | Joanna | Field | | English author hoping to clue in on what's missing in life was known to keep a journal to help her key into what, in her daily life, made her joyful. That journal was published in 1934 and called "A Life of One's Own". | Have you ever kept a diary, have you discovered anything about what make's you tick after having read excerpts? |
| I am not a woman, I am a human being. | | Indira | Gandhi I | 1917–1984 | Started her political career as official hostess and political confidant to her father, Jawaharlal Nehru, the first prime minister of an independent India. She rose through the ranks to be elected prime minister in 1966 and again in 1980. She was assassinated by one of her own body guards in 1984. | |
| The motto should be; rather than forgive one another; rather understand one | Is forgiveness unnecessary when it is replaced with understanding? | Emma | Goldman | 1869–1940 | Red Emma an American anarchist who in 1883, was actively agitating people against tyrannical employers, | There's just nothing like those homespun girls of yesteryear. Think her assassin partner shared her |

-continued

| Quote | Quote Comment | First Name | Last Name | Life-span | Biography | Biography Comment |
|---|---|---|---|---|---|---|
| another. | | | | | and for her efforts was jailed in New York. She founded the anarchist monthly, Mother Earth, with a loose cannon of a partner who would eventually he charged with attempted assassination. | understanding? |
| Time is nature's way of preventing everything from happening at once. | | | Graffiti | | The reason spray paint cans are prohibited for sale to people under 18 in some States. | There are some pearls arising from this form of creativity. |
| Time is an illusion perpetuated by the manufacturers of space. | Trekkies.Put that in your space-time continuum, and see how long it takes. | | Graffiti | | The reason spray paint cans are prohibited for sale to people under 18 in some States. | There are some pearls arising from this form of creativity. |
| The body is a sacred garment, Its your first and last garment; it is what you enter life in and what you depart life with, and it should be treated with honor. | How do you most honor your body, do you have a ritual like a long hot bath every Sunday eve, or do you honor whims and feed it junk food? | Martha | Graham | 1893–1991 | She became the most influential person in the history of modern dance she created a new dance language intended to express psychological complexities through innovative dance movement. | She not only treated her body with honor, she taught it to communicate! |
| Plain women know more about men than beautiful ones do. | An odd and perceptive quote from a beautiful and gifted women. | Katherine | Hepburn | 1909– | Beautiful. Four time Academy Award winner, who maintained a 25 year relationship with co-star Spencer Tracy | Do you suppose she had homely moments? |
| Mix a little foolishness with your serious plans; it is lovely to be silly at the right moment. | What defines the "right moment" to be foolish or silly, hindsight? Right moment you were lovely, wrong moment you were an idiot. | | Horace | 65–8 BC | Horace, Quintus Horatius Flaccus (65–8 BC.) Roman poet laureate and satirist, extraordinarily popular perhaps due to his expression of common thoughts and feelings, not high ideals. | What surroundings or circumstances can you imagine exists for Horace in 8 BC to produce such original thoughts and expressions? |
| And the trouble is, if you don't risk anything, you risk even more. | When is a risk worth taking, and when isn't it? Is there ever no risk involved? | Erica | Jong | 1942– | The author of Fear of Flying apparently didn't worry what risks she took with her good name. Her book was among the first sexual liberation novels written in the just "coming out" 70's. | |
| Life is either a daring adventure, | Considering this is Helen Keller, her | Helen | Keller | 1880–1968 | At the age of 19 months she became blind and | |

-continued

| Quote | Quote Comment | First Name | Last Name | Life-span | Biography | Biography Comment |
|---|---|---|---|---|---|---|
| or nothing. | every waking, conscious moment had to be an adventure into the unknown, don't you think. | | | | deaf. This did not stop her from earning a bachelor degree and becoming a highly respected lecturer, writer and scholar. | |
| I believe that truth and unconditional love will have the final word in reality. | What type of character did this man possess to maintain a belief in truth and unconditional love while surrounded by lies, hate, and anger. | Martin Luther | King Jr. | 1929–1968 | A strong advocate of non-violent protest ironically assassinated while acting as one of the principal leaders of the civil rights movement. Winner of Nobel and Kennedy Peace prize and considered a brilliant orator. | |
| The only unnatural sex act is that which you cannot perform. | As a species do we have the ability to do something unnatural? | Alfred | Kinsey | 1894–1956 | Controversial American sexologist and zoologist born in Hoboken, New Jersey. | No wonder he was controversial. |
| Some women are not beautiful- they only look as though they are. | Give examples of beauty that are not manifested physically, go further than the obvious. Name your friends attributes. | Karl | Kraus | 1874–1936 | Austrian satirist, critic, and poet who took great joy in attacking the middle class and liberal press. | |
| It's only when we truly know and understand that we have a limited time on earth --- and that we have no way of knowing when our time is up --- that we will begin to live each day to the fullest as if it was the only one we had. | This simple statement seems to sum it all up, don't you think? | Elizabeth | Kubler-Ross | | Swiss born pioneer psychiatrist in the study of the psychology of dying. Published what is considered to be the most influential book on the subject called "On Death and Dying" in 1969. | |
| To err is human; to admit it, superhuman. | What does that make Clinton, super president? | Doug | Larson | | NONE | |
| Title 14 Section 1211 of the code of federal Regulations implemented July 16, 1969 makes it illegal for any US citizen to have any contact with an | So . . . if you're abducted and the Feds find out do you have to do jail time. Does that make two abductions? | Loopy Obscure | Laws | Neverending | Strange but true non the less. | |

-continued

| Quote | Quote Comment | First Name | Last Name | Life-span | Biography | Biography Comment |
|---|---|---|---|---|---|---|
| extraterrestrial or their vehicle. | | | | | | |
| Cats in Sterling, Colorado may not run loose without having been fit with a taillight. | | Loopy Obscure Laws | | Neverending | Strange but the law non the less. | |
| In North Dakota it is illegal to serve beer and pretzels at the same time. | Do you think they want to keep the salt intake down to slow the drinking before driving, or do they want to keep food out of you so you are easier to spot while DUI? What tangled webs we weave! | Loopy Obscure Laws | | Neverending | Strange but true non the less. | |
| In NY the penalty for jumping off a building is death. | | Loopy Obscure Laws | | Neverending | Strange but true non the less. | |
| In Hornytown, say it ain't so, North Carolina, massage parlors have been banned! | Which came first, the town's name, or the massage parlors? | Loopy Obscure Laws | | Neverending | Strange but true non the less. | |
| It is good to have an end to journey towards; but it is the journey that matters in the end. | It is the journey that makes the memories in the end, isn't it? | Ursula | Le Guin | 1929– | She grew up immersed in legends and myths thanks to an anthropologist father and her mother an author of children's books. It's no wonder she became a multi award-winning author of science fiction and fantasy. | Do you know anyone whose profession and talents that have been shaped by their parents professions? |
| To mention a loved object, a person, or a place to someone else is to invest that object with reality. | Does she want us to take care of what we mention and how we say it? | Anne Morrow | Lindbergh | 1906– | American writer and aviator whose accomplishments as a female aviator are over shadowed by her famous husband Charles. She is most famous for her writing and not for her extraordinary pioneering spirit. | |
| Chaos in the midst of chaos isn't funny, but chaos in the midst of order is. | Picture someone in a situation of chaos among order. | Steve | Martin | 1945 | Comic, writer, and talented actor born in Waco Texas who seem to have made a great deal of his career out of | What can you expect from someone who co-wrote and made their screen debut as a title character in a |

-continued

| Quote | Quote Comment | First Name | Last Name | Life-span | Biography | Biography Comment |
|---|---|---|---|---|---|---|
| | | | | | chaotic, comedic events. | film called "The Jerk" |
| I never forget a face, but in your case I'll make an exception. | | Groucho | Marx | 1890–1977 | Born Julius Henry he was the bushy eye browed, cigar smoking, wisecracking oldest of the vaudeville, stage and movie actor brothers. Groucho also authored Memoirs of a Mangy Lover in 1963. | |
| Feelings are everywhere -- Be gentle. | | J | Massi | | NONE | |
| Admit your errors before someone else exaggerates them. | Great way to turn the tables or baffle your enemies. | Andrew | Mason M.D. | | NONE | |
| For Where your treasure is, there will your heart be also. | What do you treasure most, does it bring happiness? | | Matthew | | One of Jesus' people. | |
| Whether women are better than men I cannot say - but I can say they are certainly no worse. | Ever see animals exhibit a bias based on gender? | Golda | Mier | 1898–1978 | Israel's first ambassador to Moscow, on to Minister of Labor then Minister of Foreign Affairs and finally on to Prime Minister in 1968. | Truly a women who proved her ability to do a man's job even if that meant heading the government through two very difficult wars. |
| Don't be humble. You're not that great. | What would it require to make being humble acceptable? | Golda | Mier | 1898–1978 | Born in Russia, graduated from Milwaukee Teachers college. While in her teens she began a life long dedication to building a homeland for the Jews, she is considered one of the founders of the state of Israel and served as it's prime minister 1969–1974 | Proof that no dream is too great if a child in her teens can aspire to and achieve something so difficult as finding a homeland for a whole race of people! |
| When one tugs at a single thing in nature, he finds it attached to the rest of the world. | Think of examples that relate to you own family, do you think Mr. Muir's comment becomes more clear as you relate it from your family to the family of the world. | John | Muir | 1838–1914 | Explorer, naturalist, writer and crusader for the preservation of natural resources in the late 1800's. | Without the help of John Muir many of our most treasured National Parks would not exist today. When we have such wonderful results from his vision. Why is it we still don't understand the connectedness of all things, and |

-continued

| Quote | Quote Comment | First Name | Last Name | Life-span | Biography | Biography Comment |
|---|---|---|---|---|---|---|
| | | | | | | continue to allow greed to actively destroy our planet. |
| We don't see things as they are, we see them as we are. | Is it possible to completely make that separation? | Anais | Nin | 1903–1977 | American author influenced by surrealism and psychoanalysis, nice combo, she created many short stories, works of erotica, and her first novel was House of Incest. | |
| In our play we reveal what kind of people we are. | Is there a "type" of person who enjoys certain forms of play? | Publius Ovidus Naso | Ovid | 43 BC–17 AD | Extraordinary Roman attorney who devoted himself, instead, to of all things poetry. In 8 AD he was banished by Augustus for reasons unknown. | Maybe Augustus didn't like his poetry, which was hard to overlook because he was a most prolific poet. |
| It is often hard to distinguish between the hard knocks in life and those of opportunity. | Have you observed in your own life or another situation where a truly difficult time resulted in a wonderful opportunity? | Frederick | Phillips | | NONE | |
| You can discover more about a person in an hour of play than in a year of conversation. | What type of play do you think was popular in Plato's day? | | Plato | 427–347 BC | His philosophy has had an incalculable influence on almost every period and tradition placing him among the most important philosophers of all time. Two other great figures of philosophy are his teacher, Socrates, and Aristotle his pupil and subsequent principal competitor. | Imagine what it would be like to sit with these guys, the surroundings, clothing, smells and sounds, use all of your senses. |
| Almost always it is the fear of being ourselves that brings us to the mirror. | Is the reflection just a reminder of the part we are playing at the moment? | Antonio | Porchia | | NONE | |
| Nobody can make you feel inferior without your consent. | Even if you think your dog is an inferior creature, he doesn't. | Eleanor | Roosevelt | 1884–1962 | Chaired the United Nations Commission that created the Universal Declaration of Human Rights from which emerged the prohibition | Obviously a women who didn't suffer from an inferiority complex. |

-continued

| Quote | Quote Comment | First Name | Last Name | Life-span | Biography | Biography Comment |
|---|---|---|---|---|---|---|
| | | | | | of discrimination on grounds of race color or creed. | |
| You must do the thing you think you cannot do. | What do you think you can't do and why? | Eleanor | Roosevelt | 1884–1962 | U.S. delegate to the United Nations, niece of President Theodore Roosevelt, Wife and distant cousin of FDR. | Apparently there wasn't much she couldn't do whether she thought she could or not. |
| When a man is wrapped up in himself, he makes a pretty small package. | Are creatures other than humans able to be self-consumed, or is it the only way they can be? | John | Ruskin | 1819–1900 | British poet, author, and art critic privately educated until he attended Oxford. He encouraged England to take responsibility for the squalor that arose with ungoverned capitalism. He was a profoundly religious man who took this concept all the way to a type of Christian Communism. | He took his thoughts to extremes and beginning in 1870 he suffered periodic bouts of insanity. Is the taking of thoughts to extremes a contributing factor or a symptom of insanity? |
| The Miss Universe contest taught me how to compete. And competing among women is very different from competing among men. Women are fiercer competitors. | | Irene | Saez | | Winner of the Miss Universe title in 1981 she went on to try to capture another prestigious title, that of president of Venezuela. | |
| The more articulate one is, the more dangerous words become. | | May | Sarton | | Prolific poet from Belgium who lived out her later years in Northeastern US where she is considered a cult figure to a circle of women. | You must be pretty articulate to be made a cult figure. |
| Being bald is an unfailing sex magnet. | | Telly | Savalas | | Lolly pop sucking actor born with the name Ernst Stavro Blofeld. | |
| Time and trouble will tame an advanced young women, but an advanced old women is uncontrollable by any earthly force. | | Dorothy | Sayers | 1893–1957 | British author of detective mysteries was one of the first women to obtain a degree from Oxford. | |
| Every man takes the | Yet, no one sees | Arthur | Schopenhauer | 1788–1860 | German Pessimist | His Quote seems to be |

-continued

| Quote | Quote Comment | First Name | Last Name | Life-span | Biography | Biography Comment |
|---|---|---|---|---|---|---|
| limits of his own field of vision for the limits of the world. | things in the same way, does this make the possibilities limitless and very limited. | | | | Philosopher. The first of the primary articles of his pessimistic philosophical creed was Subjective Idealism being, for example, the idea that the world is an illusion of the brain and therefore in itself, nothing. | in direct contrast to this part of his philosophical beliefs. |
| What is most beautiful in virile men is something feminine. What is most beautiful in feminine women is something masculine. | In what way is this shown in our culture? | Susan | Sontag | 1933– | American philosophical writer on modern culture. It was her essays that got her dubbed a new intellectual and she became the influential darling of the American counterculture. | |
| I love humanity but I hate people. | | Edna | St. Vincent Millay | 1892–1950 | The winner of a 1923 Pulitzer she was mainly recognized for her poetry. She also wrote plays for experimental theater, one of which was a satirical fantasy about war called Aria Da Capo. | |
| As far as I'm concerned, morality is just a word that describes the current fashion of conduct. | | Sally | Stanford | | Celebrated and politically motivated Madam and vice-mayor of Sausalito California. | Probably not related to the Stanford's of university fame don't you just know it? |
| In the year 2000 approximately 19 million women Baby Boomers will be suffering anxiety, irritability, and violent mood swings due to menopause. | Be Afraid! Be Very Afraid, if we don't start talking about it. | | Statistics | | Who figures these things out, and why? | |
| If you're over 35 you have a 1 in 77 chance of suffering a heart attack during sex. | The moral of the story . . . if you're gonna fool around be in shape! | | Statistics | | Who figures these things out, and why? | |
| Very attractive men and women earn at least 5% per hour | Homely criminals get 50% more jail time than good-looking | | Statistics | | Who figures these things out, and why? | |

-continued

| Quote | Quote Comment | First Name | Last Name | Life-span | Biography | Biography Comment |
|---|---|---|---|---|---|---|
| more than average looking ones. | ones. | | | | | |
| Ideas are like rabbits. You get a couple and learn how to handle them, and pretty soon you have a dozen. | Could they have possibly imagined what was about to spring from the idea of the first computer? | John | Steinbeck | 1902–1968 | American novelist, who apparently could make literary, prizes multiply as well. He was awarded 1940 Pulitzer and the 1962 Nobel prize for literature. | |
| It is necessary to any originality to have the courage to be an amateur. | If, in fact, it is an original, are you not the amateur and the master? | Wallace | Stevens | 1879–1955 | Harvard educated insurance attorney who won n the 1955 Pulitzer Prize for his extraordinary poetry. | Just goes to show you can't judge a man by his profession! |
| Man does not live by words alone, despite the fact that sometimes he has to eat them. | Some go down easier than others. | Adlai | StevensonA | 1900–1965 | Well known more for his wit and speaking ability than his failed run for the presidency in 1952 and in 1956. | |
| There is no duty we so much underrate as the duty of being happy. By being happy we sow anonymous benefits upon the world. | Since laughter and happiness can contagious . . . go out and spread it! | Robert Louis | StevensonR | 1850–1894 | Well traveled Scottish essayist who lived the last 5 years of his life in Samoa acknowledged as chief Tu'si-ta'la (teller of tales). | Happiness might well lie in being chief spinner of tales in Samoa. |
| There is nothing stronger in the world than gentleness. | | Han | Suyin | 1917– | Beijing doctor and author of the inter-racial romance novel turned academy award winning movie, Love Is A Many Splendid Thing. | |
| Could a greater miracle take place than for us to look through each others eyes for an instant. | Try to look through each others for an instant, what do you see? Now try it with a loved pet or some other creature. | Henry David | Thoreau | 1817–1862 | Perhaps most famous for his portrayal of simple living, it was his essay on civil disobedience that influenced Mahatma Gandhi's successful policies of passive resistance against the British rule in India. | |
| Happy families are all alike; every unhappy family is unhappy in it's own way. | | Lao Nikolsevich | Tolstoi | 1875–1877 | Russian author of War and Peace who, between his use of psychological analysis in his novels and his social teachings had a profound effect on the course of the 20th century. Tolstoy's idea for passive resistance | |

-continued

| Quote | Quote Comment | First Name | Last Name | Life-span | Biography | Biography Comment |
|---|---|---|---|---|---|---|
| | | | | | influenced Gandhi whom later inspired Martin Luther King Jr. | |
| Live each moment as if your hair is on fire! | | Suzannah | Troy | | Somewhere, sometime a masseuse. | Quite a laid back profession for such a frenetic quote. |
| I never let my schooling interfere with my education. | Doesn't this give us a fresh interpretation of education. | Mark | Twain | 1835–1910 | Mark Twain, Samuel Langhorne Clemens, American writer and humorist known for debunking tradition without malice and being satirical without bitterness, for the most part. | |
| When ignorance gets started it knows no bounds. | | Mark | Twain | 1835–1910 | Unique American writer who poked fun at entrenched institutions and long held traditions. He did so for the most part without malice until 1890–1900 when his life's hard knocks were being reflected in his writing. | |
| Always acknowledge a fault frankly. This will throw those in authority off their guard and give you the opportunity to commit more. | How do you think this would throw them "off guard"? | Mark | Twain | 1835–1910 | Unique American writer who poked fun at entrenched institutions and long held traditions. He did so for the most part without malice until 1890–1900 when his life's hard knocks were being reflected in his writing. | |
| Men show their character in nothing more clearly than by what they think laughable. | What's the last thing that made you laugh out loud? Now think about that. | Johann Wolfgang | Von Goethe | 1749–1832 | German poet, dramatist, scientist and court official who partook in more than one scandalous love affair. He dabbled in alchemy, occult philosophy, and astrology as well as music, art, anatomy, and chemistry. | All of this experience collided to make him one of the most versatile figures in world literature. |
| Expect nothing; live frugally on surprise. | Can having no expectations eliminate disappointments? | Alice | Walker | 1944– | African American author and recipient of many literary honors | As a young black women aspiring to be an author do you think |

-continued

| Quote | Quote Comment | First Name | Last Name | Life-span | Biography | Biography Comment |
|---|---|---|---|---|---|---|
| | | | | | including a Pulitzer and American Book Award both for her novel "The Color Purple". | she ever expected to win such high honors? |
| The whole world is a comedy for those who think a tragedy for those who feel. | Do you see this in people you know? | Horace | Walpole | 1717–1797 | Respected writer of letters and novels, the 4th Earl of Orford, was appointed to many cushy government jobs by his father, the prime minister. His inheritance purchased coachmen's cottage, which he stuccoed into the pseudo-castle of Strawberry Hill. He unwittingly helped put an end to the ridiculous fashion for Classical Italian appearance of architecture in England. | His philosophy was modern day and not stuccoed in the past. Option 2 He should have stuck to writing and not remodeling. |
| Did a women ever love who would not give all the years of tasteless serenity, for one year, for one month, for one day of uncalculated delirium of love poured out upon the man . . . who returned it. | Wouldn't you have expected this to have been said by a woman and not a Twain crony? | C. D | Warner | 1829–1900 | Charles Dudley Warner (1829–1900) American writer/attorney till 1860 when he quit law to become editor of Harpers Magazine. Collaborated with Mark Twain on The Gilded Cage in 1873. | C. D. Warner was male, what do you think could have happened for him come up with such a female oriented comment? |
| A guilty conscience is the mother of invention. | Just ask any kid caught with their hand just outside the cookie jar, and the creativity will fly!! | Carolyn | Wells | 1862–1942 | American writer of some 170 volumes. She was diversified in her genre, humorous sketches, novels and fictional detective stories to name a few. | She must have had a very guilty conscience to have created 170 volumes of fiction. |
| When women go wrong, men go right after them. | | Mae | West | 1893–1980 | Buxom vaudevillian with the dubious distinction of having a inflatable life vest named after her. | |
| Women should be obscene and not heard. | You might say Mae was the one of the original women to be obscene and heard! | Mae | West | 1893–1980 | Popular personality of 30's Hollywood who epitomized aggressive vulgarity with comic flair. Audiences loved | |

-continued

| Quote | Quote Comment | First Name | Last Name | Life-span | Biography | Biography Comment |
|---|---|---|---|---|---|---|
| | | | | | it! | |
| Between two evils I always pick the one I never tried | How many evils could a vaudeville and film actress who specialized in sultry sexual innuendo have left untried? | Mae | West | 1893–1980 | Popular personality of 30's Hollywood who epitomized aggressive vulgarity with comic flair. Audiences loved it! | |
| Ninety-nine percent of the people in the world are fools and the rest of us are in great danger of contagion. | | Thornton Niven | Wilder | 1897–1975 | Fought in two wars, rose to rank of lieutenant colonel. Wilder found time to be Yale educated and win several Pulitzer prizes for his literature that was often based on allegories and myths. Among his works are Our Town and Hello Dolly. | |
| You don't have to be a thing of beauty to be a joy forever. | Flip sashayed around stage in drag, he was no beauty but the joy he brought others made him one of the funniest comics of the late 60's and early 70's. | Flip | Wilson | | Born Clerow Wilson, one of 24 children and no stranger to foster homes and reform school, he became one of the first black superstars through his gift for comedy. | While in the Air force he often proclaimed to be flipped out, soon it stuck and his friends nicknamed him Flip. |

I claim:

1. An improved method of participating in a game involving two or more persons by combining said game with a communication activity, where the game has triggering events which start communication phases of the communication activity, said method comprising:

a) providing an operating format of rules for playing the game, identifying events in the game that are triggering events and establishing procedures for the communication activity;

b) providing an information source having a plurality of items of information which are capable of stimulating or eliciting comment, opinions, or perception, with said procedures for the communication activity specifying that the comment, opinions, or perceptions do not require a response or answer which is deemed to be correct or incorrect, or be a right or wrong response or answer;

c) said persons beginning to participate as participants in said game by taking part in the game;

d) upon occurrence of a triggering event in the game, initiating a communication phase of the communication activity by providing to at least one participant one of said items of information;

e) as a part of the communication phase said at least one participant or another participant expressing a thought or thoughts related to, generated by, stimulated by, and/or suggested by, the item of information with the expressing of the thought or thoughts being done so as not to be deemed correct or incorrect;

f) also as part of the communication phase, optionally providing an opportunity for comment by one or more additional participant or participants to be able to make a further expression or expressions of a thought or thoughts related to or suggested by the thought or thoughts of said at least one participant or another participant or participants and/or by the item of information provided, with a requirement of no assertion or conclusion being made of correctness or merit of comments or expressions of another;

g) in situations where one of the participants is expressing a judgment of the comments or expressions as being right or wrong, or correct or incorrect, initiating a defusion or diversion phase to redirect or terminate the communication phase;

h) returning to the game by the participants again participating in said game after said communication phase.

2. The method as recited in claim 1, wherein the items of information are selected at least in part in a random manner.

3. The method as recited in claim 2, wherein the items of information comprise at least in part information on one or more of the following, namely, quotations, originators of quotations, biographical information on originators, information related to the quotations, statistics, fascinating facts, idioms, origin of idioms, superstitions, origins of superstitions, opinions, opinion poll results, oxymorons, ads or headlines, ridiculous ads or headlines, historical facts, historical trivia, news trivia, word origins, information on customs, living modes, or activities of other cultures, cultures of other times, hypothetical occurrences or situations, and/or other items of information to initiate discussion.

4. The method as recited in claim 1, wherein said items of information are provided in one or more of the following ways, namely, printed material or cards, audio outputs, visual displays, electronic media, or internet participation.

5. The method as recited in claim 1, wherein the items of information comprise at least in part information on one or more of the following, namely, quotations, originators of quotations, biographical information on originators, information related to the quotations, statistics, fascinating facts, idioms, origin of idioms, superstitions, origins of superstitions, opinions, opinion poll results, oxymorons, ads or headlines, ridiculous ads or headlines, historical facts, historical trivia, news trivia, word origins, information on customs, living modes, or activities of other cultures, cultures of other times, hypothetical occurrences or situations, and/or other items of information to initiate discussion.

6. The method as recited in claim 5, wherein said information items are provided in one or more of the following ways, namely, printed material or cards, audio outputs, visual displays, electronic media, and/or internet participation.

7. The method as recited in claim 6, comprising timing periods and/or timing devices for limiting or monitoring timing of discussion phase occurrences.

8. The method as recited in claim 6, wherein the items of information comprise at least in part one or more of the following, namely, quotations, originators of quotations, biographical information on originators, and/or information relating to the quotations.

9. The method as recited in claim 1, further providing timing periods and/or timing devices for limiting or monitoring timing of discussion phase occurrences.

10. The method as recited in claim 1, wherein the diversion or defusion phase is implemented by activating a diversion or defusion device which provides a message or impression at least in part relating to one or more of the following, namely, an antagonistic or argumentative mood, a judicial or decision making impression, a commentary of evaluating impression, a communication of some displeasure or lack of approval of a situation.

11. The method as recited in claim 10, wherein the defusion device comprises one or more of the following devices, namely a device representing or simulating a grumpy person, a representation or configuration of a judicial person, a device which can be manipulated to cause a display or representation of a comment or evaluation and/or an animal-like representation or configuration communicating some displeasure or lack of approval of a situation.

12. The method as recited in claim 1, wherein the items of information comprise at least in part one or more of the following, namely, quotations, originators of quotations, biographical information on originators, and/or information relating to the quotations.

13. The method as recited in claim 12, wherein the items of information are selected at least in part in a random manner.

14. The method as recited in claim 1, wherein progress of events in the game or game-like activity and the events in the communication activity are substantially unrelated, in that in accordance with the operating format, events of the communication activity do affect the game or game-like activity.

* * * * *